US009044077B1

(12) United States Patent
Lin

(10) Patent No.: US 9,044,077 B1
(45) Date of Patent: Jun. 2, 2015

(54) EYELASH HOLDER

(71) Applicant: Pro-Iroda Industries, Inc., Taichung (TW)

(72) Inventor: Yu-Chih Lin, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 0 days.

(21) Appl. No.: 14/302,462

(22) Filed: Jun. 12, 2014

(30) Foreign Application Priority Data

Jan. 20, 2014 (TW) ..... 103102023 A

(51) Int. Cl.

| | |
|---|---|
| ***B65D 71/00*** | (2006.01) |
| ***A45D 44/00*** | (2006.01) |
| ***A41G 5/02*** | (2006.01) |
| ***B65D 85/18*** | (2006.01) |

(52) U.S. Cl.
CPC *A45D 44/00* (2013.01); *A41G 5/02* (2013.01); *B65D 85/18* (2013.01)

(58) Field of Classification Search
USPC ..... 206/756, 764, 765, 581, 775, 560, 565, 206/564
See application file for complete search history.

(56) References Cited

U.S. PATENT DOCUMENTS

| | | | | | |
|---|---|---|---|---|---|
| 2,503,552 | A * | 4/1950 | Hassler | ..... | 132/217 |
| 3,315,689 | A * | 4/1967 | Melik | ..... | 132/317 |
| 3,333,593 | A * | 8/1967 | McGivern | ..... | 132/217 |
| 4,018,336 | A * | 4/1977 | Aylott | ..... | 206/460 |
| 4,717,024 | A * | 1/1988 | Djezovic | ..... | 206/581 |
| 2002/0117423 | A1 * | 8/2002 | Jackson | ..... | 206/581 |
| 2013/0160787 | A1 * | 6/2013 | Chae et al. | ..... | 132/201 |
| 2014/0110304 | A1 * | 4/2014 | Wu et al. | ..... | 206/776 |

FOREIGN PATENT DOCUMENTS

| | | |
|---|---|---|
| TW | M401345 | 4/2011 |

* cited by examiner

*Primary Examiner* — Jacob K Ackun
(74) *Attorney, Agent, or Firm* — Alan D. Kamrath; Kamrath IP Lawfirm, P.A.

(57) ABSTRACT

An eyelash holder includes a base and at least one eyelash mount disposed on the base. The at least one eyelash mount includes an eyelash positioning edge and at least one holding means disposed on the eyelash positioning edge. The at least one holding means includes a first end connecting to the eyelash positioning edge and a second end separating from the eyelash positioning edge with an eyelash holding space.

10 Claims, 8 Drawing Sheets

EYELASH HOLDER

BACKGROUND OF THE INVENTION

1. Field of the Invention

The present invention relates to an eyelash holder and, particularly, to an eyelash holder allowing a user to get the eyelashes out of it easily.

2. Description of the Related Art

TW Patent No. 401345 shows an eyelash holder including a base and an eyelash mount for receiving an eyelash. The eyelash mount is disposed on the base. The eyelash mount is of a crescent shape. Therefore, the shape of eyelash mount and the shape of the eyelash attached thereto correspond to each other. When an eyelash is attached to the eyelash mount, it includes two distal ends thereof adhering to the eyelash mount. The eyelash can be fixedly held and avoid deformation. However, it is a trouble to release the eyelash from the eyelash mount. A user would have to use a tool to break adhesive connections between the eyelash mount and the eyelash attached thereto, and generally cuts the two ends of the eyelash in order to avoid deforming and breaking the eyelash.

The present invention is, therefore, intended to obviate or at least alleviate the problems encountered in the prior art.

SUMMARY OF THE INVENTION

According to the present invention, an eyelash holder includes a base and at least one eyelash mount disposed on the base. The at least one eyelash mount includes an eyelash positioning edge and at least one holding means disposed on the eyelash positioning edge. The at least one holding means includes a first end connecting to the eyelash positioning edge and a second end separating from the eyelash positioning edge with an eyelash holding space.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide an eyelash holder including an eyelash mount for storing an eyelash.

It is another objective of the present invention to provide an eyelash holder in which eyelashes are able to be stored easily and conveniently.

It is yet another objective of the present invention to provide an eyelash holder that doesn't deform and break eyelashes, especially when getting the eyelashes out of the eyelash holder.

Other objectives, advantages, and new features of the present invention will become apparent from the following detailed description of the invention when considered in conjunction with the accompanied drawings.

DETAILED DESCRIPTION OF THE INVENTION

Figure 1:
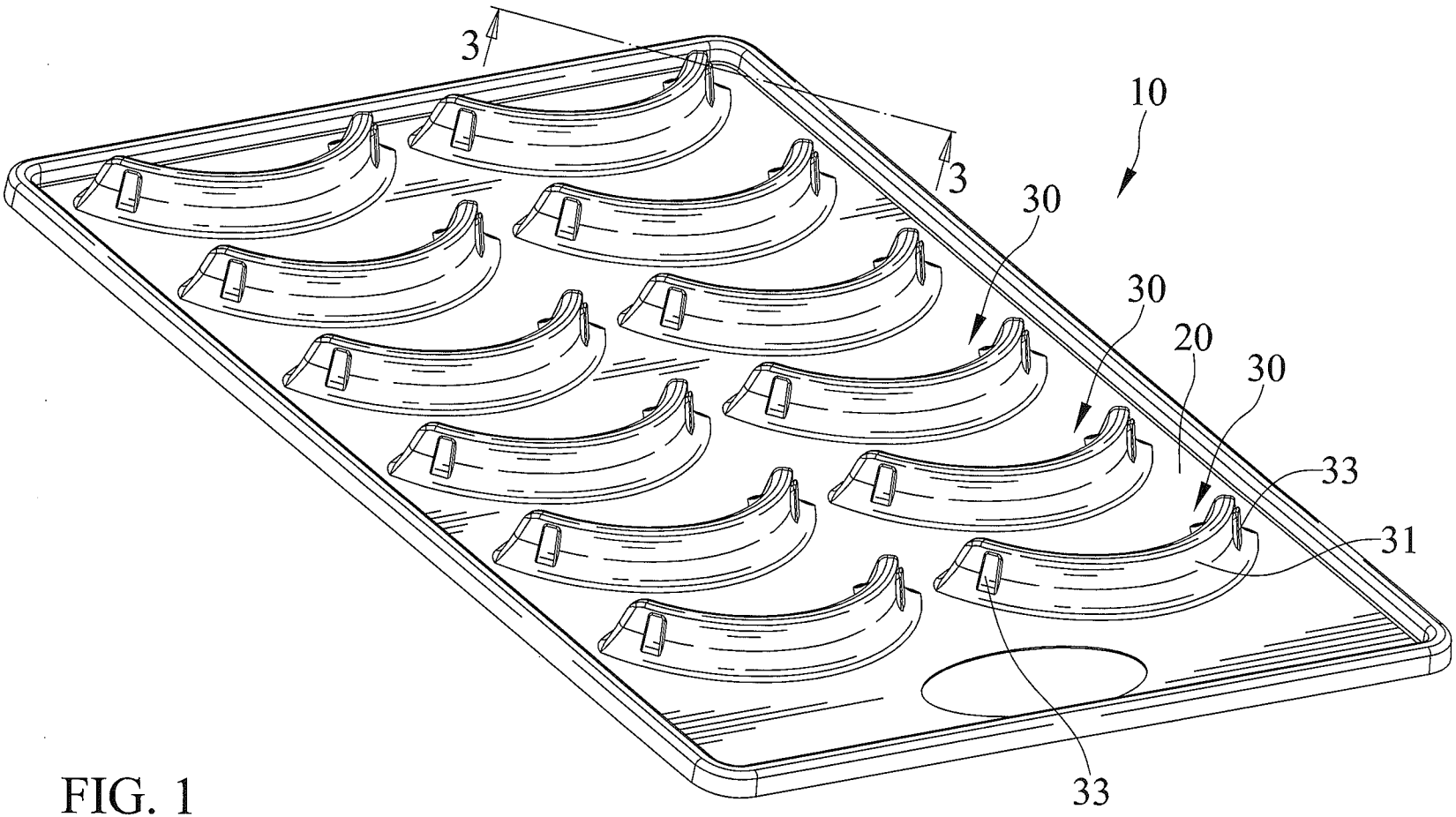
FIG. 1 is a perspective view of an eyelash holder in accordance with a first embodiment of the present invention.
Figure 2:
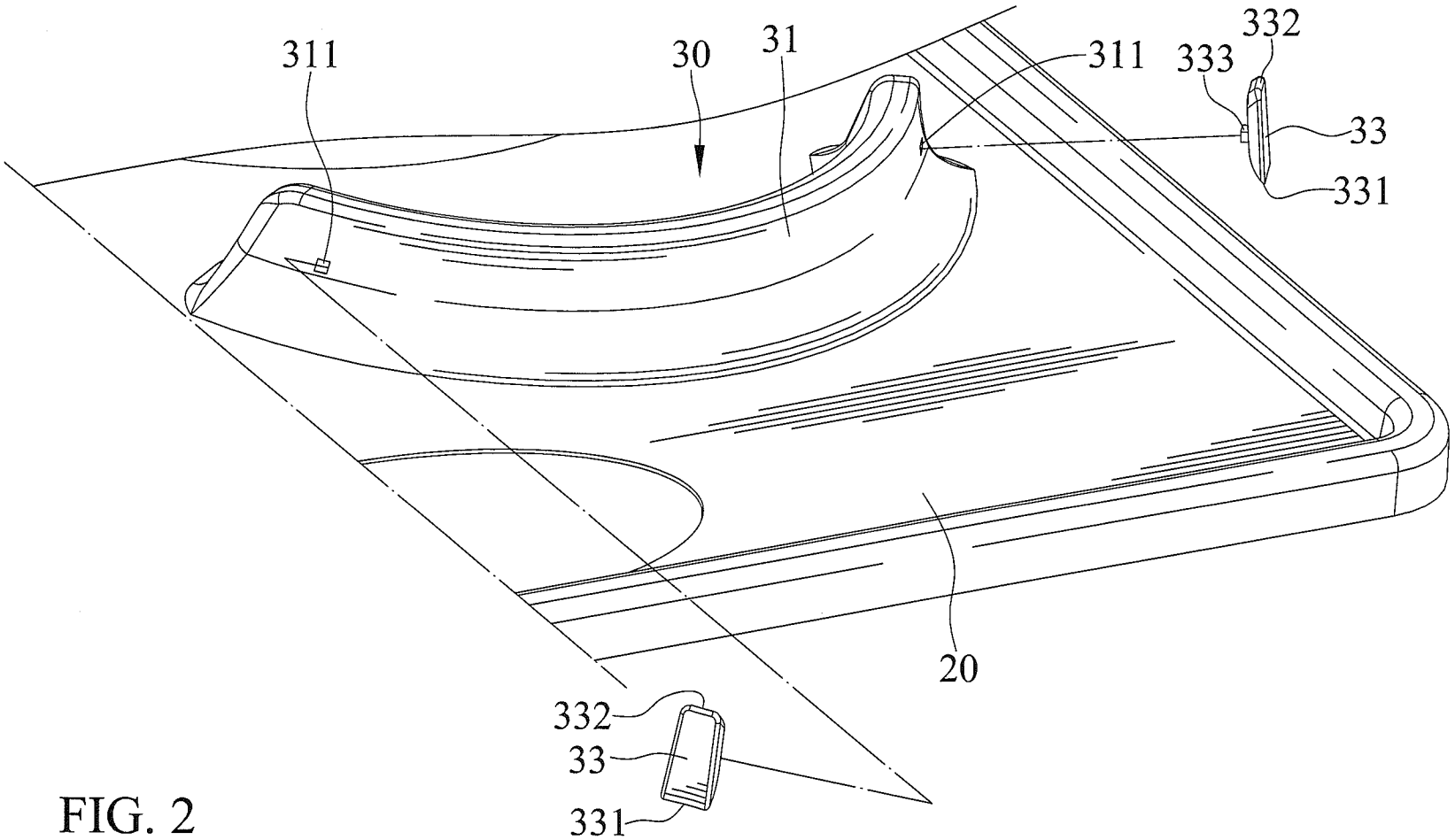
FIG. 2 is a partial, exploded perspective view of the eyelash holder shown in FIG. 1.
Figure 3:
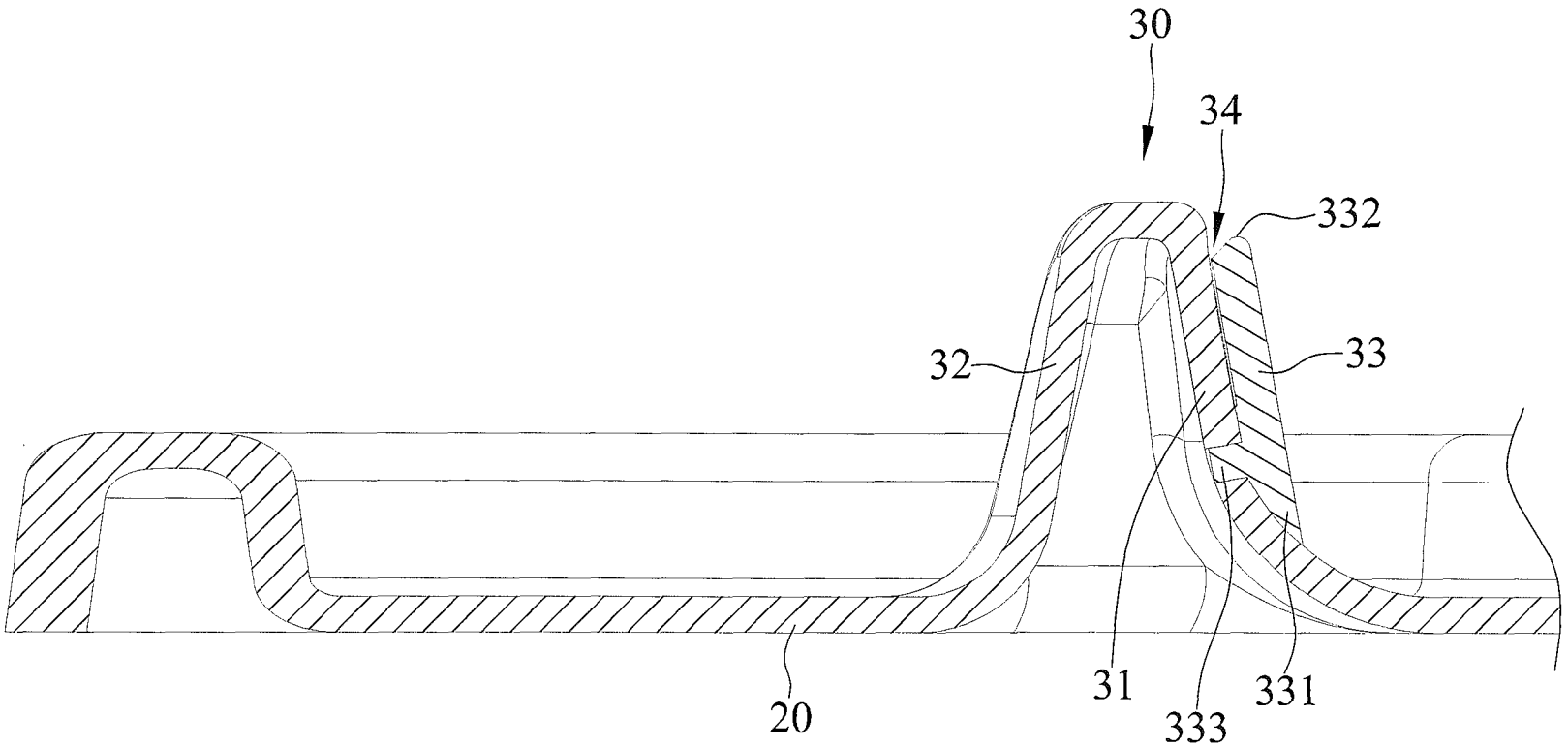
FIG. 3 is a cross-sectional view taken along line 3-3 of FIG. 1.
Figure 4:
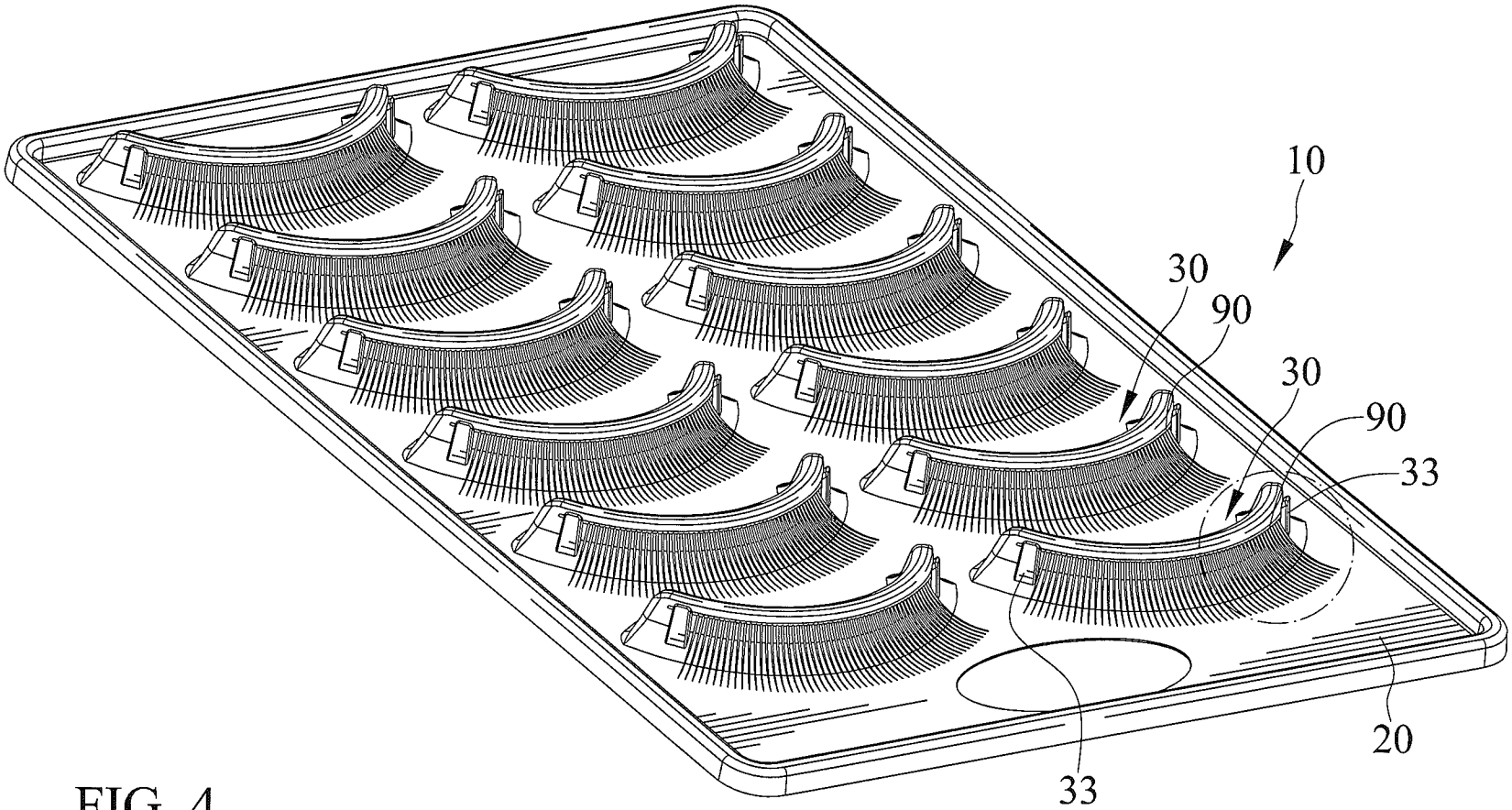
FIG. 4 is a perspective view of the eyelash holder shown in FIG. 1 and a plurality of eyelashes, with the plurality of eyelashes mounting on the eyelash holder.
Figure 5:
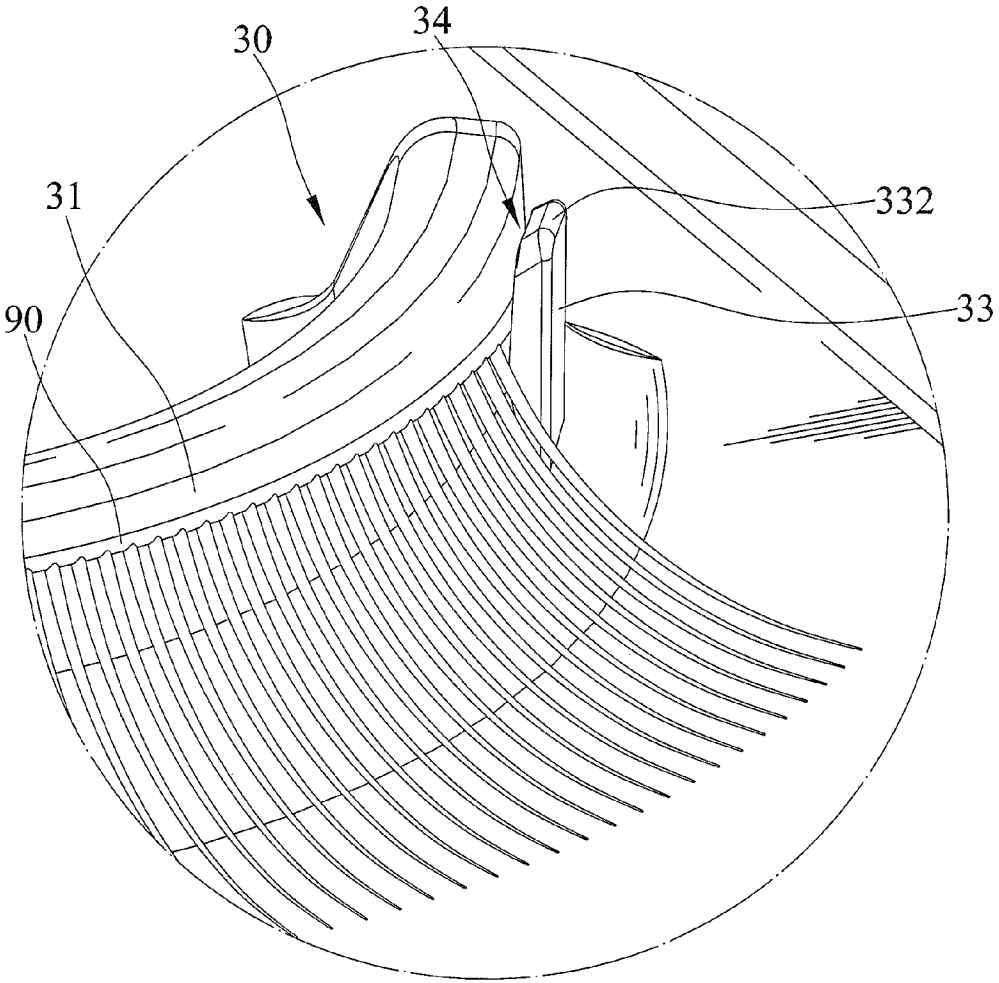
FIG. 5 is a partial, enlarged view of FIG. 4.

FIGS. 1 through 5 show an eyelash holder 10 in accordance with a first embodiment of the present invention. The eyelash holder 10 includes a base 20 and at least one eyelash mount 30. The at least one eyelash mount 30 is disposed on the base 20 and includes an eyelash positioning edge 31.

The at least one eyelash mount 30 has a curved shape with two curved lateral sides. The at least one eyelash mount 30 has a first distal end and a second distal end, and each of the two curved lateral sides extends annularly from the first distal end to the second distal end. The at least one eyelash mount 30 includes one of the two curved lateral sides defining the eyelash positioning edge 31 and the other defining an back edge 32. The at least one eyelash mount 30 has a concavo-convex shape, with the eyelash positioning edge 31 being convex, and with the back edge 32 being concave. The eyelash positioning edge 31 is curved. The at least one eyelash mount 30 protrudes above the base 20. Each of the two curved lateral sides of the at least one eyelash mount 30 has a bottom connecting to the base 20 and a top at a height above the base 20. The eyelash positioning edge 31 slants from the top to the bottom of the at least one eyelash mount 30 and define a slopped edge.

The at least one eyelash mount 30 includes at least one holding means 33 disposed on the eyelash positioning edge 31. In the embodiment, the holding means 33 is in a form of a block, but not limiting. The at least one holding means 33 includes a first end 331 connecting to the eyelash positioning edge 31 and a second end 332 separating from the eyelash positioning edge 31 with an eyelash holding space 34. The eyelash positioning edge 31 includes at least one connecting area 311 connecting to the first end 331 of the at least one holding means 33. The at least one holding means 33 releasably connects to the eyelash positioning edge 31. The at least one connecting area 331 is in a form of a slot. The first end 331 of the holding means 33 includes a protrusion 333 extending therefrom and engaging with the at least one connecting area 311.

An eyelash 90 has an eyelash strip and a plurality of individual lashes extending transversely from the eyelash strip. The eyelash 90 can be fixedly stored in the eyelash holder 10 in that the eyelash strip is disposed and restrained in the eyelash holding space 34. The eyelash 90 includes the plurality of individual lashes disposed outside the eyelash holding space 34 and draping on the eyelash positioning edge 31. The plurality of individual lashes draping on the eyelash positioning edge 31 can keep curved.

There are two holding means 33, with the two holding means 33 disposed separately on the eyelash positioning edge 31 of the at least one eyelash mount 30, with one holding means 33 and the eyelash positioning edge 31 delimiting a first eyelash holding space 34 for receiving a first distal end of an eyelash 90, and with the other holding means 33 and the eyelash positioning edge 31 delimiting a second eyelash holding space 34 for receiving a second distal end of the eyelash 90.

The base 20 and the at least one eyelash mount 30 are made out of a material and become a one-piece structure. The base 20 and the at least one eyelash mount 30 are injection molded.

The at least one eyelash mount 30 includes a plurality of eyelash mounts. In the embodiment, the plurality of eyelash mounts 30 is arranged in two columns, but not limiting.

Figure 6:
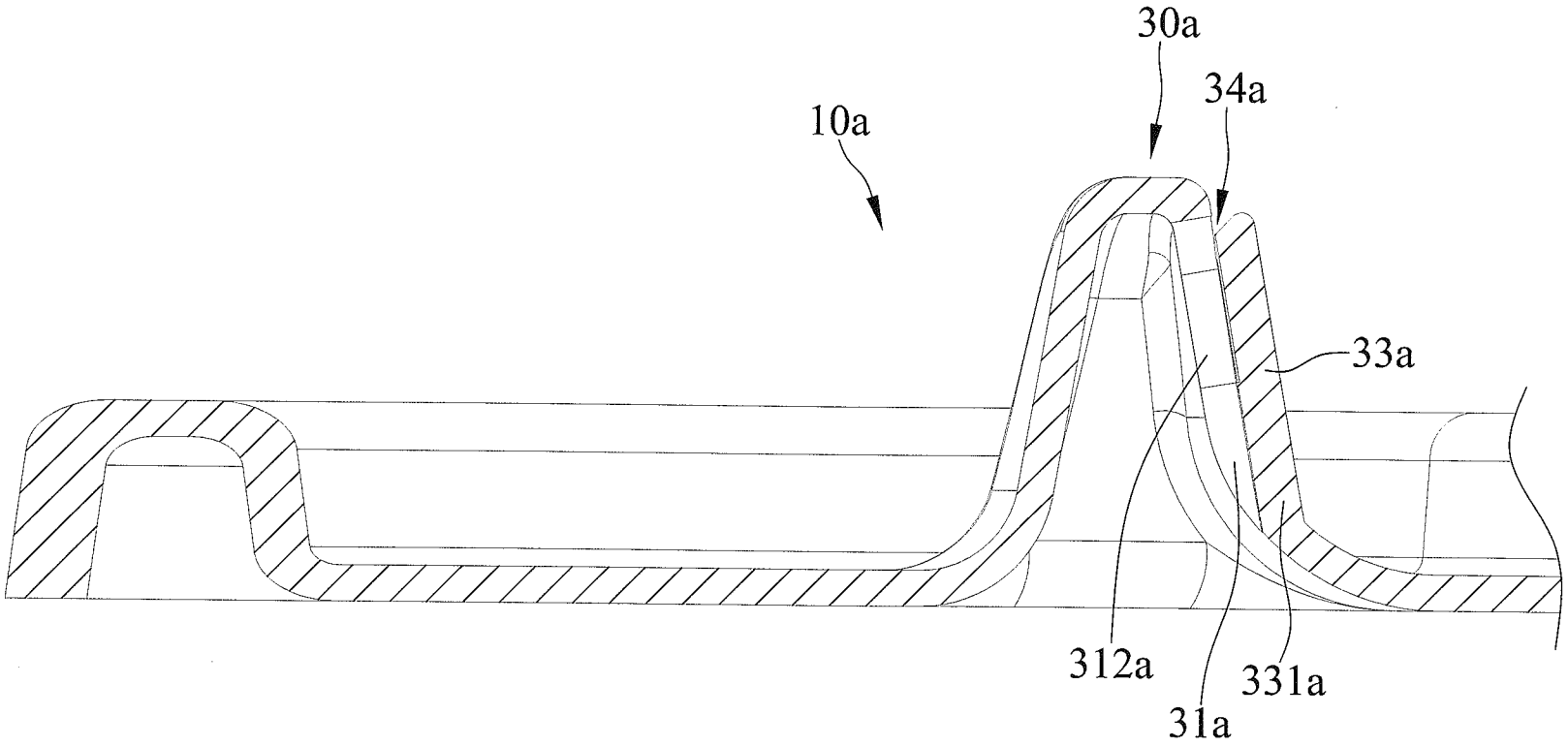
FIG. 6 is a cross-sectional view showing an eyelash holder in accordance with a second embodiment of the present invention.
Figure 7:
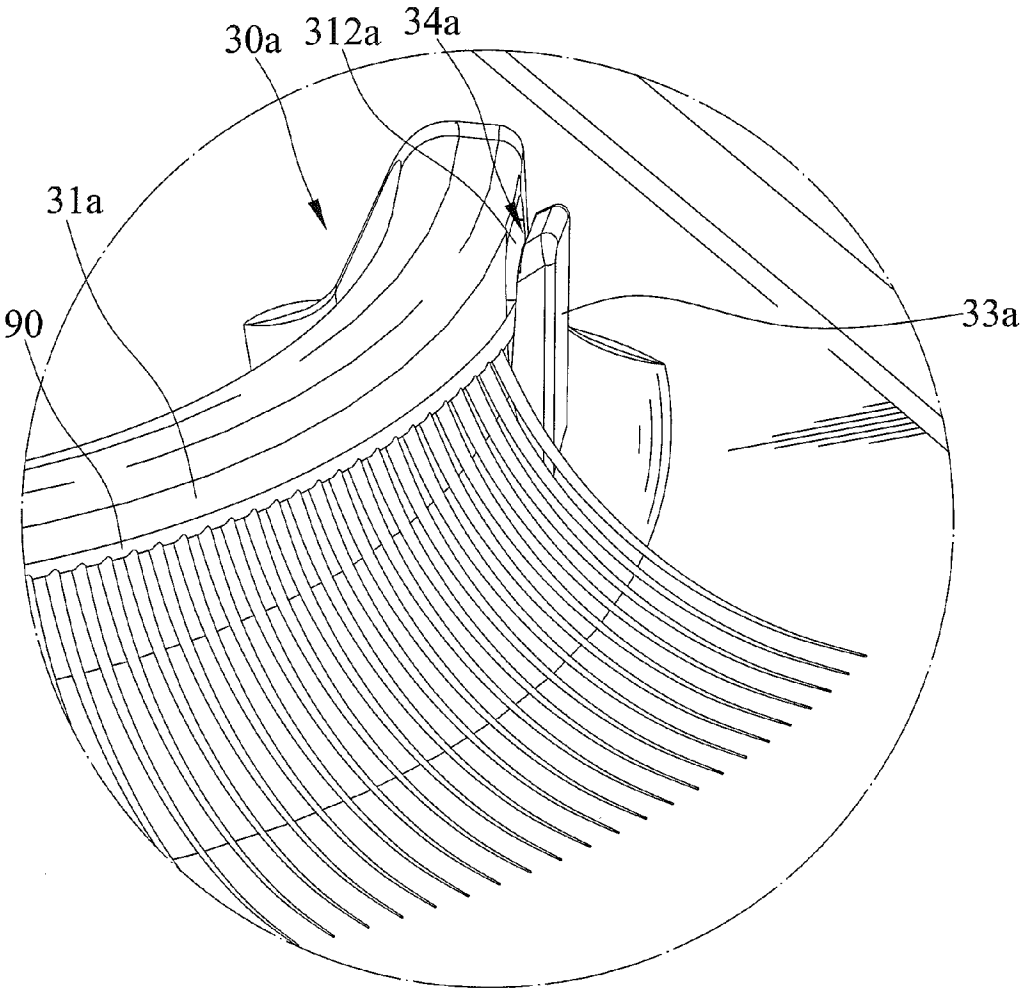
FIG. 7 is a partial, enlarged perspective view of the eyelash holder of FIG. 6 and an eyelash, with the eyelash mounting on the eyelash holder.
Figure 8:
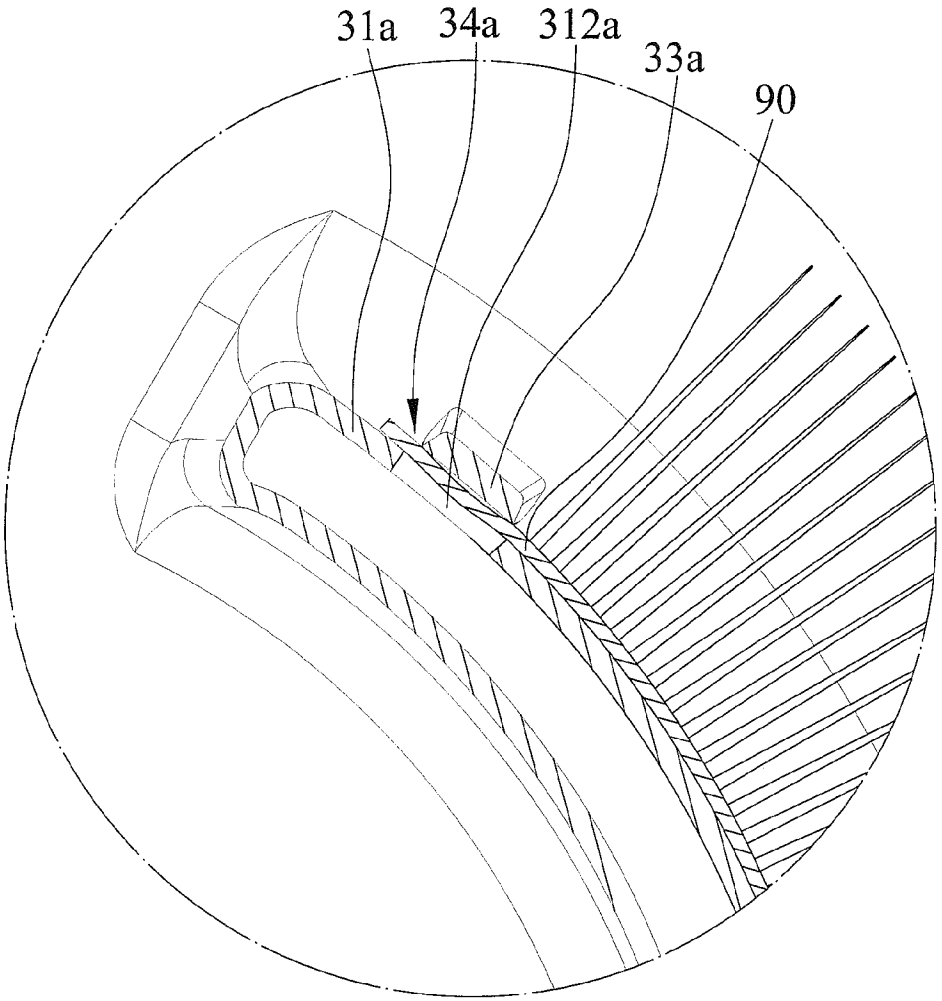
FIG. 8 is a cross-sectional view of FIG. 7.

FIGS. 6 through 8 show an eyelash holder 10*a* in accordance with a second embodiment of the present invention, and same numbers are used to correlate similar components of the first embodiment, but bearing a letter a. The second embodiment differentiates from the first embodiment in that at least one holding means 33*a* and at least one eyelash mount 30*a* are made out of a material and become a one-piece structure. The at least one holding means 33*a* and the at least one eyelash mount 30*a* are injection molded. In addition, an eyelash positioning edge 31*a* of the at least one eyelash mount 30*a* includes a recess 312*a* disposed corresponding and connecting to an eyelash holding space 34*a* formed between the at least one holding means 33*a* and the eyelash positioning edge 31*a*.

The strip of the eyelash 90 that is disposed in the eyelash holding space 34*a* is thus received by the recess 312*a*. The strip of the eyelash 90 includes some length not received in the eyelash holding space 34*a* and the recess 34*a*. The eyelash 90 can also be fixedly stored in the eyelash holder 10*a*.

In view of the forgoing, eyelashes are able to be releasably stored in the eyelash holders 10 and 10*a* easily and conveniently. Moreover, the eyelash holders 10 and 10*a* don't deform and break eyelashes, especially when getting the eyelashes out of the eyelash holders 10 and 10*a*.

The foregoing is merely illustrative of the principles of this invention and various modifications can be made by those skilled in the art without departing from the scope and spirit of the invention.

What is claimed is:

1. An eyelash holder (10, 10*a*) comprising:

a base (20); and at least one eyelash mount (30, 30*a*) disposed on the base and including an eyelash positioning edge (31, 31*a*) and at least one holding means (33, 33*a*) disposed on the eyelash positioning edge, with the at least one holding means including a first end (331, 331*a*) connecting to the eyelash positioning edge and a second end (332) separating from the eyelash positioning edge with an eyelash holding space (34, 34*a*).

2. The eyelash holder (10, 10*a*) as claimed in claim 1, wherein the eyelash positioning edge (31, 31*a*) includes at least one connecting area (311) connecting to the first end (331, 331*a*) of the at least one holding means (33, 33*a*).

3. The eyelash holder (10) as claimed in claim 2, wherein the at least one connecting area (331) is in a form of a slot, and wherein the first end (331) of the holding means (33) includes a protrusion (333) extending therefrom and engaging with the at least one connecting area.

4. The eyelash holder (10, 10*a*) as claimed in claim 1, wherein the at least one eyelash mount (30, 30*a*) has a curved shape with two curved lateral sides, wherein the at least one eyelash mount (30, 30*a*) has a first distal end and a second distal end, and each of the two curved lateral sides extends annularly from the first distal end to the second distal end, and wherein the at least one eyelash mount includes one of the two curved lateral sides defining the eyelash positioning edge (31, 31*a*) and the other defining an back edge (32).

5. The eyelash holder (10, 10*a*) as claimed in claim 4, wherein the at least one eyelash mount (30, 30*a*) protrudes above the base (20), and wherein each of the two curved lateral sides of the at least one eyelash mount (30, 30*a*) has a bottom connecting to the base (20) and a top at a height above the base (20).

6. The eyelash holder (10, 10*a*) as claimed in claim 5, wherein the eyelash positioning edge (31, 31*a*) slants from the top to the bottom of the at least one eyelash mount (30, 30*a*) and define a slopped edge.

7. The eyelash holder (10*a*) as claimed in claim 1, wherein the eyelash positioning edge (31*a*) includes a recess (312*a*) disposed corresponding and connecting to the eyelash holding space (34*a*).

8. The eyelash holder (10, 10*a*) as claimed in claim 4, wherein the at least one eyelash mount (30, 30*a*) has a concavo-convex shape, with the eyelash positioning edge (31, 31*a*) being convex, and with the back edge (32) being concave.

9. The eyelash holder (10, 10*a*) as claimed in claim 1, wherein the at least one holding means (33, 33*a*) includes two holding means, with the two holding means disposed separately on the eyelash positioning edge (31, 31*a*) of the at least one eyelash mount (30, 30*a*), with one holding means and the eyelash positioning edge delimiting a first eyelash holding space for receiving a first distal end of an eyelash (90), and with the other holding means and the eyelash positioning edge delimiting a second eyelash holding space for receiving a second distal end of the eyelash.

10. The eyelash holder (10, 10*a*) as claimed in claim 1, wherein the at least one eyelash mount (30, 30*a*) includes a plurality of eyelash mounts.

* * * * *